US009764927B2

(12) United States Patent
Kalliomäki

(10) Patent No.: US 9,764,927 B2
(45) Date of Patent: Sep. 19, 2017

(54) ELEVATOR

(71) Applicant: KONE CORPORATION, Helsinki (FI)

(72) Inventor: Jaakko Kalliomäki, Vantaa (FI)

(73) Assignee: KONE CORPORATION, Helsinki (FI)

( * ) Notice: Subject to any disclaimer, the term of this patent is extended or adjusted under 35 U.S.C. 154(b) by 618 days.

(21) Appl. No.: 14/061,411

(22) Filed: Oct. 23, 2013

(65) Prior Publication Data

US 2014/0048357 A1 Feb. 20, 2014

Related U.S. Application Data

(63) Continuation of application No. PCT/EP2012/056927, filed on Apr. 16, 2012.

(30) Foreign Application Priority Data

May 20, 2011 (EP) ..... 11166930

(51) Int. Cl.
*B66B 5/22* (2006.01)
*B66B 5/18* (2006.01)
*B66B 3/02* (2006.01)

(52) U.S. Cl.
CPC ..... *B66B 5/18* (2013.01); *B66B 5/22* (2013.01); *B66B 3/02* (2013.01)

(58) Field of Classification Search
CPC B66B 5/22; B66B 5/24; B66B 5/0018; B66B 5/0006; B66B 5/18; B66B 1/32
USPC ..... 187/288, 375, 393, 394, 404, 376
See application file for complete search history.

(56) References Cited

U.S. PATENT DOCUMENTS 1,980,230 A * 11/1934 See ..... B66B 5/08 187/350
5,224,570 A * 7/1993 Fromberg ..... B66B 5/22 187/376
5,370,208 A * 12/1994 De Jong ..... B66B 5/22 187/372
6,109,398 A 8/2000 Lempiö et al.
6,305,503 B1 * 10/2001 Suzuki ..... B66B 1/3476 177/147

(Continued)

FOREIGN PATENT DOCUMENTS

CA 2032214 1/1996
WO WO 2009/050326 A1 4/2009
WO WO 2012/048748 A1 4/2012

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator has a car, arranged to be moved along at least one guide rail in an elevator guide way, the car having a brake for braking the car movement by gripping the guide rail, the brake having a gripping device configured to grip the guide rail and exert a friction force thereon, and an adjusting device configured to adjust the gripping device with respect to its friction force exerted on the guide rails in case of braking. The adjusting device is configured to adjust the gripping device depending on the car position in the elevator guide way. With the above construction, emergency braking is allowed, particularly in higher and high rise elevators with a stopping distance which is mostly unaffected by the position of the elevator car in the guide way.

17 Claims, 3 Drawing Sheets

(56) References Cited

U.S. PATENT DOCUMENTS

| | | | | |
|---|---|---|---|---|
| 2003/0085078 | A1* | 5/2003 | Simmonds | B66B 5/22 187/373 |
| 2004/0262091 | A1* | 12/2004 | Ito | B66B 5/22 187/372 |
| 2006/0249337 | A1* | 11/2006 | McNamara | B66B 7/10 187/412 |
| 2007/0051563 | A1* | 3/2007 | Oh | B66B 5/22 187/371 |
| 2008/0128218 | A1* | 6/2008 | Gremaud | B66B 5/22 187/250 |
| 2010/0038184 | A1* | 2/2010 | Emmerich | B66B 5/18 187/288 |
| 2010/0187047 | A1 | 7/2010 | Gremaud et al. | |

* cited by examiner

Prior art 80
82
87
84
86
64, 66

ELEVATOR

CROSS-REFERENCE TO RELATED APPLICATIONS

This application is a continuation of PCT International Application No. PCT/EP2012/056927 filed on Apr. 16, 2012, which claims priority under 35 U.S.C 119(a) to Application No. 11166930.5 filed May 20, 2011 in Europe, all which are hereby expressly incorporated by reference in the present application.

The invention refers to an elevator having an elevator car arranged to be moved along at least one guide rail in an elevator guide way. The car has a brake, generally a device known as a safety gear, capable of braking the car movement intensely by gripping the guide rail in case of emergency, particularly in the case of car overspeed when a predefined car speed is exceeded. In the emergency the brake is meant to stop the car soon as possible without endangering passenger safety. The most common triggering criteria is overspeed (e.g. via an overspeed governor), which may take place for instance if the support of hoisting ropes is lost, which is an ultimate and a rare emergency. In some elevators, the brake can be also triggered with alternative criteria, such as in case of an accident or in case of a severe failure of an elevator component. Such known elevators may get problems particularly in case of high rise elevators. In high rise elevators the weight of the elevator supply cable and/or the compensation rope forms an essential part of the weight of the elevator car. In an elevator hoist way with a height of e.g. 300 m the weight of the elevator supply cable and the compensation ropes may sum up to several tons, i.e. a weight which is essentially larger than the elevator car itself and its load. Emergency braking of the elevator car at different positions of the elevator car in the shaft will thus lead to different stopping distances based on the weight difference which has to be decelerated. Accordingly, the stopping distance in the upper part of the shaft is considerably longer than in the lower part of the elevator shaft where the weight of the elevator car is mostly unaffected by the remaining supply cable and/or compensation rope suspended at the elevator car. Whereas in the lower shaft part the stopping may not be performed with such a high deceleration rate that passengers might be injured the stopping distance in the upper part must not become too large to prevent the danger of a run through of the car, e.g. if the working condition of the brake is changed, e.g. because of heat or oil vapors.

It is therefore object of the present invention to provide an elevator with a stopping distance of the brake which is mostly independent of the position of the elevator car in the elevator guide way.

The object is solved with an elevator according to claim 1. Preferred embodiments of the invention are subject matter of the sub-claims.

The elevator according to the invention has brake for emergency braking with a gripping means for gripping the guide rail and exerting a friction force thereon and adjusting means for adjusting the friction force exerted by the gripping means on the guide rails in case of braking. According to the invention the adjusting means are configured to adjust the gripping force of the gripping means depending on the car position in the elevator guideway.

According to the invention the adjusting means adjusts the friction force exerted by the gripping means on the guide rails in case of braking. The term "is configured to adjust the gripping force of the gripping means depending on the car position in the elevator guideway" means that the adjusting means has an input for information regarding the position of the car in the shaft and a transmitting means which transforms the position information into a mechanical and/or electrical pre-adjustment of the gripping means, which leads to a certain gripping force in case of braking. The adjustment can e.g. done by affecting the position or the brake path of the gripping elements of the gripping means. Via this configuration the adjusting means is able to adjust the gripping force depending on the car position in the elevator guide way.

By that adjusting means it is possible to increase the gripping force of the gripping means with a higher car position in the elevator shaft. This ensures in case of an emergency braking that in the upper part of the elevator shaft the stopping distance is sufficiently short whereas in the lower part the gripping force is sufficiently low to avoid an exaggerated deceleration which might affect the safety of the passengers in the car. Accordingly, with the solution of the invention a quite constant deceleration of the elevator car in case of emergency braking can be obtained throughout the complete shaft length.

A very relevant item of the present invention is the active pre-adjustment of the braking capacity before the actual braking happens. This is an important advantage, as the braking situation occurs very rapidly and thus it is difficult to perform a brake force adjustment during the actual braking. Therefore, advantageously said adjustment means for adjusting the gripping means or limit means are configured to adjust the gripping force during normal elevator travel, i.e. in a non-braking situation. The benefit of this attribute is that pre-adjustment of the gripping force ensures the brake force setting is constantly kept in a desired position already before the braking is needed. Thus, during the very rapid actual braking situation, no adjustment is needed any longer. This allows a much more reliable and much more sensitive braking force adjustment than in any solutions where the braking force is adjusted during the braking.

Furthermore, the invention provides the following advantages:

- It allows controlling the deceleration ratio at the ends of the travel,
- when the pre-adjusted deceleration is increased at the upper end of the shaft the risk of run through in a case of a negative change of the friction conditions is reduced
- when the pre-adjusted deceleration is decreased at the lower end of the shaft the risk of injuring passengers because of a too high deceleration is reduced.
- elevators with a shaft height above 300 m can be delivered in cases where deviations from safety codes are not permitted.

The mechanism to trigger the brake in case of an emergency situation is unaffected by the present invention. Typical triggering situations are the triggering of an overspeed governor in overspeed situations or the interruption of the elevator safety circuit. Such a device is per se known from WO 2009/050326 A1.

The adjusting means preferably co-acts with said indication means indicative of the position of the elevator car in the elevator guide way. Thus, the adjusting means gets the information regarding the car position in the shaft from said indication means. This indication means may be any known device for obtaining car position information, e.g. from a device which indicates the floor position of the car to the elevator control, e.g. for display in the elevator car. Further, any fixed device in the elevator shaft may be used as indication means, which device can be read by any kind of reading means, e.g. mechanical or electrical/electronic/optical reading means, connected with the elevator car. A further possibility for deriving the shaft position are markings at the overspeed governor rope which are read by a reading device connected with the car, in which case no additional structures have to be fixed in the shaft to obtain the car position.

If the indication means is mounted at/in the elevator shaft it might preferably comprise a kind of data carrier which co-acts with a data reader mounted at the elevator car. In an embodiment of the present invention, this indication means is a bar that is tilted at a small angle with respect to the vertical axis of the elevator shaft. This bar is engaged by a roller connected with the adjusting means at the elevator car, whereby the roller is pressed against the edge of the bar by a spring means for adjusting the gripping force of the gripping device. In that the bar is mounted to the elevator shaft over the complete shaft length, the actual position of the roller running along the edge of the bar indicates the car position in the shaft. Another possibility of an indicating means is a vertical bar or band having recesses or other markings or data carriers which change along the shaft length. These markings or data carriers could be read by a mechanical or optical reading means to obtain the actual position of the elevator car. A very simple indication means which does not necessitate any further installations in the elevator shaft is the weight of the supply ropes of the elevator car and/or of the compensation ropes which are generally provided in high rise elevators. As the weight of the elevator supply cable/s as well as the weight of the compensation rope increases with a higher position of the car in the shaft any of these ropes and/or cables may be used as the indication means. This has the advantage that a very effective control of the gripping force of the gripping device over the shaft length can be obtained simply by using elements which are already present in any kind of high rise elevators. Therefore no added structures are necessary to obtain the car position information.

In the latter case the weight of the compensation ropes or of the car supply cable preferably acts on a transmitting member designed to vary its shape and/or its position depending on the weight of the rope or cable portions acting on it. Accordingly, this transmitting member could directly act on the gripping means to adjust the gripping force of the gripping means, e.g. by adjusting the sliding surfaces for the gripping wedges. The transmitting member could also be connected with limit means limiting the gripping force which is exerted by the gripping means or gripping wedges on the elevator guide rails. The limit means is usually a part of the gripping means but can also be part of the adjusting means.

The adjustment can be performed by setting the gripping means of the brake in such a manner that in case of braking a certain gripping force is achieved. This setting can be continuously or in a stepwise manner. It is also possible to adjust the gripping force by activating a various number of gripping means of the brake. The car may e.g. have two or four gripping means on the top and two or four gripping means at the bottom. In this case e.g. in the lower part of the shaft only the lower gripping means could be activated whereas in the upper part the lower and the upper gripping means could be activated. This would lead to an adjustability in at least two steps.

Preferably said gripping means comprises a gripping element, e.g. gripping wedges, provided to engage the respective guide rail (64, 66), particularly by wedging, and said limit means (82, 84) comprise a spring means (82), which spring means forms a yieldable mounting for the gripping element so as to limit the gripping force exerted to the guide rail by said gripping element of the gripping means in case of braking, and that said adjusting means are configured to adjust the yielding properties of the spring means to adjust the limiting effect of the limit means. By this measure a simple and reliable mechanical limit means is provided which provides based on its spring loaded setting a smooth and reliable and also pure mechanical limit means for adjusting the gripping force in case of brake action. The adjustment is thereby performed during normal operation of the brake, i.e. in non-braking situation. Therefore braking occurs safely with a pre-adjusted brake. The yielding of the spring means result in that the gripping force is limited, so that the normal force against guide rail can not develop to be excessive. The yielding can be achieved with a mounting having a spring as showed elsewhere in the application or alternatively there may even not be necessary to have separate springs, if the brake body is configured springy so it forms the spring means in itself, as in brakes of the type showed in U.S. Pat. No. 6,109,398 A for example. In that case, the adjusting of the limiting effect of the gripping force could be done by mechanically adjusting rigidity of the springy body of the gripping means e.g. with additional movable rigidifying parts.

Preferably, the transmitting member acts in this case on the counter wedge via said spring means. This provides a very reliable and easy way to transmit the change of the shape or position of the transmitting member to the limit means.

Here it is to be mentioned that generally the gripping means have gripping wedges which are pressed in case of an emergency braking against the guide rails, as it is e.g. shown in CA 2,032,214 A1. Normally, the gripping wedges are sliding on counter wedges whereby the position of the counter wedges affects the gripping force of the gripping wedges. Therefore, preferably the adjusting means acts on the counter wedges which form the limit means of the gripping means. The action of the transmitting member on the limit means or gripping means can be directly or indirectly, e.g. via a spring. Therefore, if e.g. a transmitting member is used which varies its shape or position according to the weight of the compensation rope or car supply cable, this transmitting member may act on the counter wedge to effectively adjust the gripping force of the gripping means. The benefit of this embodiment is that adjustment of braking intensity can be done without necessitating any activity during braking, such as adjusting the braking force or braking elements actively during the actual braking. This is important as the braking always happens in a very short time and makes adjusting during that short time interval complicated if not impossible. Particularly this advantageous embodiment provides generally a safe way to ensure adjustability to the braking intensity and it does so in a simple and cost-effective way.

Preferably, the adjusting means is purely mechanical as it is generally required by regulations (e.g. EN 81-1) for emergency braking devices. This has the advantage that the adjusting means acts reliably even in case of power offs. As the transmitting member co-acts with components which are already present in any high rise elevator as compensation rope(s) and/or car supply cable(s) and per se known limit means to limit the gripping force of the gripping device, any known brake can be modified according to the invention with only little effort. Also existing brake systems can be modernized according to the invention with only minor effort.

Of course, if common elevator regulations should allow the use of electric or electronic components in connection with emergency braking also electric components could be used to obtain the position information of the elevator car in the shaft (e.g. common car floor indications) and/or the adjusting means and/or limit means can be provided as electric actuators which directly or indirectly act on the gripping means.

Emergency braking can be caused by a brake of all hoisting rope (loss of suspension) in which case the elevator car accelerates downwards with earth gravity. In this case also the weight of the compensation ropes and/or elevator supply cable acting on the transmitting member would be instantly reduced to zero which would affect the gripping force adjusted by the transmitting member. In order to meet this problem preferably at least one buffer or damper is provided between the transmitting member and the elevator car which delays/dampens a change of the shape and/or the position of the transmitting member with respect to the elevator car. Therefore, even in case of a complete suspension loss of the elevator car, the transmitting member keeps its shape and/or position according to the car position during the emergency braking process. To provide proper function for this case the buffer should be able to delay the change of the position and/or change of the shape of the transmitting member over the adjustment range for a period of at least 5 seconds, preferably at least 10 seconds, e.g. up to 60 seconds.

Preferably, the limit means for limiting the gripping force of the gripping means is a mechanical limit means to satisfy common regulations which require that the emergency braking process should not be affected by any electric problems in the elevator. Regularly the limit means comprises a counter wedge and the adjustment of the limit means is performed by adjusting the position of said counter wedge with respect to a back surface which is e.g. tilted in an acute angle with respect to the guide rail. By the adjustment of the position of the counter wedge on that back surface the distance between the guide rail and the sliding surface on the counter wedge for the gripping wedge is changed. This change of the distance directly affects the gripping force of the gripping wedge which is sliding on the sliding surface of the counter wedge against the guide rail. If the sliding surface of the counter wedge has a larger distance to the guide rail the friction force is lower and when the distance is smaller the gripping force is higher.

The limit means may also be a simple stopper which limits the moving range of the gripping wedge against the guide rail, possibly by intermediation of a spring.

It should be clear that the operation of the adjusting means to adjust the gripping force of the gripping means is continuously performed during the operation of the elevator independent on the moving status of the elevator car, preferably even independent of the question whether the elevator is in operation or not, as the brake of the hoisting ropes may also occur when the elevator is not in operation. This is possible, if the adjusting means as well as the gripping means (and optionally limit means) are pure mechanical components which are not affected by the operation of the elevator control.

It has further to be noted that the activation of the gripping means in case of a loss of suspension of the elevator car is generally performed via the over speed governor which directly triggers the gripping means.

Preferably the adjustment means is configured to be adjusted depending on the moving direction of the elevator car. By this means the adjustment means is able to decrease the limiting effect of the limit means on the movement of the gripping means or to increase the gripping force when the elevator car ascends and to increase the limiting effect of the limit means on the movement of the gripping means or to decrease the gripping force when elevator car descends. Therefore, the general gripping force in case of brake actions in upwards direction can be increased without providing an exaggerated deceleration as the earth gravity acts in counter-direction of the car movement. On the other side the gripping force can accordingly be decreased in downwards direction travel which avoids undue deceleration which might harm the passengers. The car movement direction can easily obtained e.g. by a roller engaging the overspeed governor rope of the guide rail. This has the advantage that the detection of the car movement direction occurs purely mechanical and is therefore reliable and safe against power-offs. The movement direction can of course be obtained by data from a general data bus of the elevator system. Alternatively or additionally the adjustment means can also be adjustable by the car load. Also the car load can be determined by mechanical means, e.g. by spring means between the car and car frame and by actuators acting on the gripping means or limit means depending on the spring stroke, which is again dependent on the car load. Also electronic data e.g. from the data bus, based on weight sensors may be used to adjust the gripping or limit means.

For clarification purposes it shall be emphasized that with the term "adjustment of the gripping force" according to the present invention the adjustment of the brake during its non-operated (resting) state is understood, so that during activation the brake only needs to engage into its pre-adjusted gripping position. This is accomplished e.g. by affecting a counterforce, the movement path of the gripping means or by adjustment of the limit means during the resting state of the brake. The adjustment is preferably performed continuously at least during the operation of the elevator system.

The invention is now described by the aid of examples in connection with the enclosed drawing.

Figure 1:
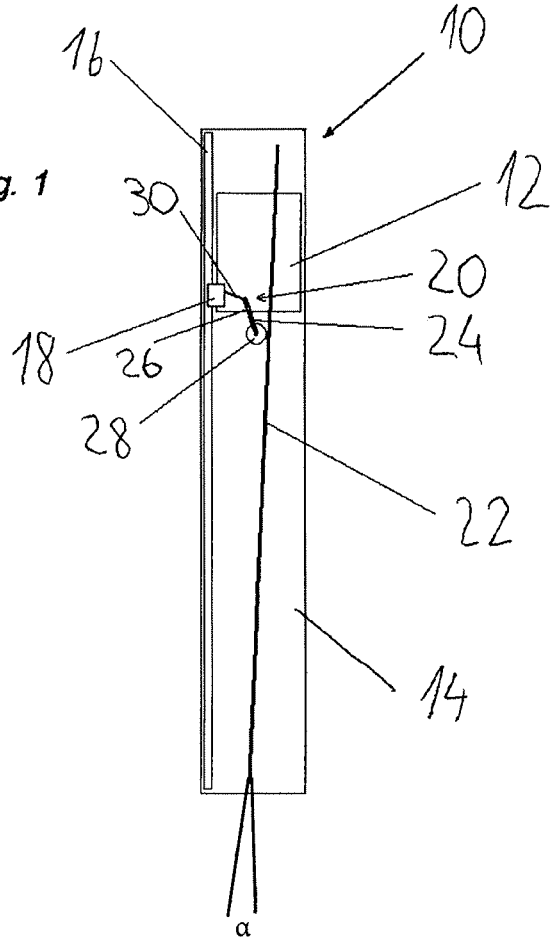
FIG. 1 shows a side view of an elevator according to the invention.

FIG. 1 shows a schematic drawing of a high rise elevator 10. Hereby it is to be noted that the scale of the drawing does not correspond to real dimensions as the height of an elevator shaft of a high rise elevator is between 30 and 300 m whereas which the width/depth of such a shaft is generally between 2 and 6 m. Furthermore, components which are not relevant for this embodiment as the elevator drive unit, the overspeed governor, the roping as well as diverting pulleys are not shown in this figure. The elevator also may have a counterweight.

The elevator 10 comprises an elevator car 12 running in an elevator shaft 14 along elevator guide rails 16. In this embodiment the elevator guide rails 16 are provided only at one side of the elevator car 12 so that the car 12 is suspended in a so-called "rucksack type suspension". Of course, also other suspension types can be applied where the elevator guide rails are located for example at opposite sides of the elevator car. The elevator car 12 is guided along the guide rails with guide rollers (not shown) engaging the guide rails 16. The elevator is further provided with a per se known over speed governor (not shown) which is intended to activate a gripping means 18 in case the car 12 exceeds a given threshold velocity. The gripping means 18 may be any known construction, e.g. gripping wedges which are pressed against the guide rail sliding on counter wedges. The elevator 10 further comprises an adjusting means 20 which is configured to adjust the gripping force of the gripping means 18 dependent on the position of the elevator car in the elevator shaft, i.e. the vertical position thereof.

The adjusting means 20 comprises a longitudinal bar 22 extending over substantially the whole shaft length which is tilted with an acute angle $\alpha$ against the vertical axis. The inclination or the size of the angle is such small that over the whole shaft length the horizontal deviation is only a few cm, e.g. 10-20 cm. This tilted bar 22 is fixed to one elevator shaft wall, particularly a shaft wall where no landing doors are provided.

On the car side the adjusting means 20 comprises an actuating lever 24 articulated around a pivot 26. At the lower end of the actuating lever 24 a roller 28 is rotatably mounted, which roller engages one side of the bar 22. The upper end of the actuating lever 24 is connected with a connecting lever 30 being mechanically connected with the gripping means 18 to change the gripping force of the gripping means 18. On this behalf the connecting lever 30 could e.g. be connected with an adjustable counter surface for the gripping wedge to adjust the distance of the counter surface to the guide rail or the connecting lever 30 could be connected with per se known counter wedge or with the base surface or stopper of a gripping wedge to adjust the gripping force of gripping means.

The tilting of the bar 22 with the angle $\alpha$ in the elevator shaft 10 is choosen in such a way that the horizontal displacement of the bar 22 between the upper and lower end of the shaft is about 15 cm. The position of the roller varies accordingly depending on the car position in the shaft. Via the displacement of the roller 28 over the shaft length the gripping means 18 is adjusted via corresponding action of the actuating lever 24 and connecting lever 30 so that in the upper end of the shaft the gripping force of the gripping device is higher and at the lower end the gripping force is lower. This can accomplished e.g. by reducing the distance between the counter surface for the gripping wedge and the guide rails at the upper end of the elevator shaft and by increasing the mutual distance between the counter surface and the guide rail near the lower end of the elevator shaft. The adjustment can also be made by adjusting the position of stoppers to limit the traveling distance of the gripping wedges.

The background for this technology is the following:

In high rise elevators the elevator car is connected with compensation ropes as well as with elevator supply cables. Particularly in high rise elevators where the shaft length is often about 100, even 200 m or 300 m the weight of the car supply cables and the compensation ropes may amount to several tons and therefore may exceed the weight of the car and its load.

By adjusting the gripping force of the gripping means via the adjusting means 20 depending on the car position in the elevator shaft 14 it is possible to maintain the substantially same stopping distance over the whole shaft length in case of emergency braking action of the gripping means. Thus the gripping force can be adjusted to be as high as possible but as low as to avoid an exaggerated deceleration which might harm passengers. Accordingly, with the invention the elevator car is stopped with nearly the same acceleration over the whole shaft distance.

Usually the gripping means 18 is triggered via the over speed governor, i.e. if the car exceeds the nominal velocity for example in case of loss of suspension (all hoisting ropes brake) or the gripping means 18 may be triggered by an interruption of the per se known elevator safety circuit.

Figure 2:
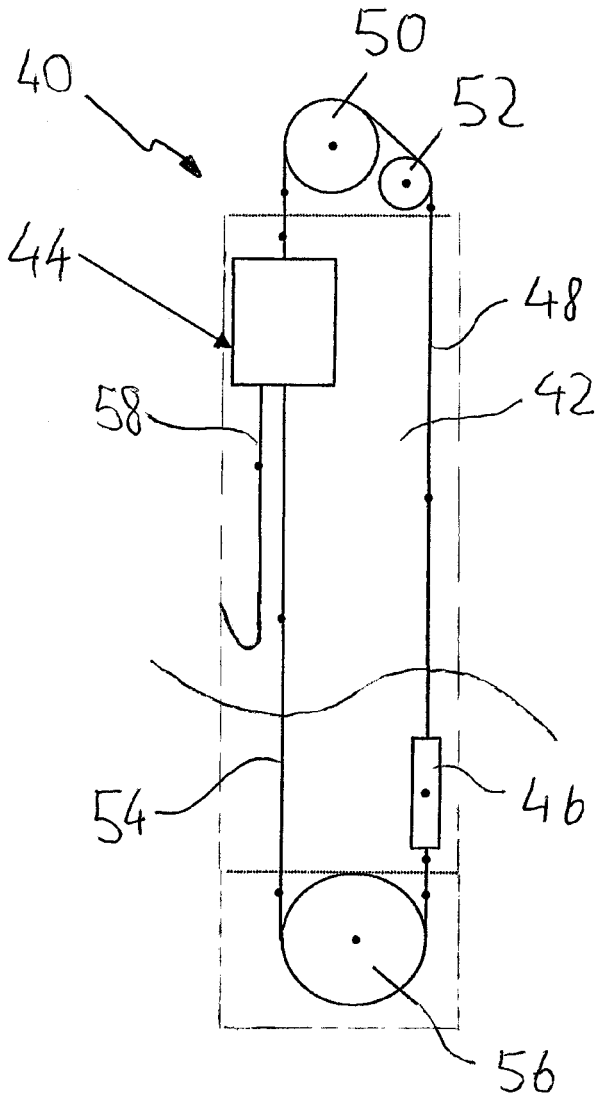
FIG. 2 shows a side view of a basic layout of a high rise elevator, as technical background of the invention.

FIG. 2 shows a general concept of a high rise elevator 40 according to prior art as technological background of the present invention. The elevator 40 comprises an elevator shaft 42 wherein a car 44 and a counter weight 46 are suspended by hoisting ropes 48. Above the elevator shaft 42 a machine room is provided housing a drive machine comprising a traction sheave 50 and a diverting pulley 52 to adjust the distance between the upwards and downwards going parts of the hoisting ropes 48. The traction sheave 50 drives the hoisting ropes 48 by means of a friction.

The elevator 40 further comprises a compensation rope 54 which is connected between the bottom of the elevator car 44 and the bottom of the counterweight 46. The compensation rope 54 runs over a tension pulley 56 located in the pit of the elevator shaft 42. It shall be understood that the hoisting ropes and the compensation ropes may comprise several separate parallel ropes or belts. Further, a car supply cable 58 is connected to the bottom of the elevator car 44, which provides the energy supply as well as the data connection for the elevator car 44 with the elevator control (not shown). The drawing shows only the upper and the lower parts of the elevator shaft. In reality the elevator shaft may have a length of several 100 m whereas the width and length of the elevator shaft may vary between less than 2 and several m, e.g. 5 m. The elevator also may be a counter weightless elevator and also the diverting pulley 52 in the upper part adjacent to the drive unit 50 is optionally. It shall be further understood that the drive machine unit 50 could also be located in the elevator shaft 42 as a kind of machine room less solution. Also, the compensation rope is optional as the invention allows the sole use of the car supply cable as indication means for the car position. And already the weight of the car supply cable might require the inventive adjustment of the gripping force depending on the car position.

The elevator car of FIG. 2 may use the gripping device and the adjusting means as shown in FIG. 1. On the other hand in the basic layout of FIG. 2 a solution is preferable where the weight of the compensation rope 54 and/or the car supply cable 58 is used to adjust the gripping force of the gripping means as the weight thereof is dependent on the position of the elevator car 44 in the elevator shaft 42, as it is shown in FIG. 3.

Figures 3, 4:
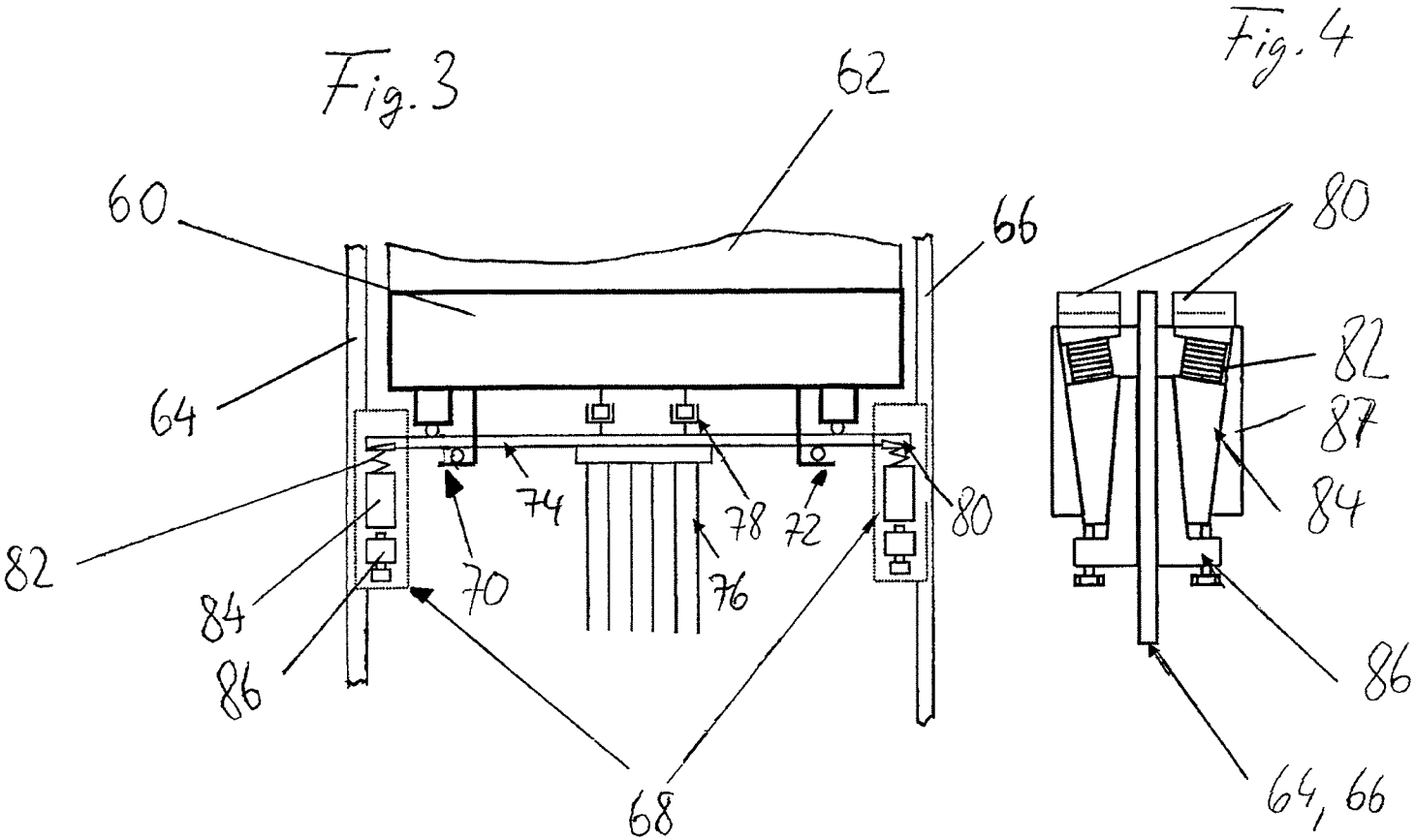
FIG. 3 shows a side view of the lower part of an inventive high rise elevator with a basic layout e.g. according to FIG. 2.
FIG. 4 shows the limit means and gripping means of FIG. 3 in a detailed view.

FIG. 3 shows the sling bottom beam 60 of an elevator car 62. The figure further shows two guide rails 64, 66 as well as a gripping means 68 co-acting with guide rails 64, 66. A more detailed view of the gripping means 68 is shown in FIG. 4. FIG. 3 does not show the connection between the gripping means 68 and the elevator car, e.g. via mounting beams. At the lower end of the sling bottom beam 60 two bearing points 70, 72 are provided for a transmitting member 74. The transmitting member 74 is a horizontal bar with certain elasticity. The center of the transmitting member 74 is connected with a suspension of the compensation ropes 76, so that the weight of the compensation ropes 76 pull the center of the transmitting member 74 between the two bearings 70, 72 downwards. The center of the transmitting member 74 is further connected with the lower end of buffers 78, the upper ends thereof being connected to the bottom of the sling bottom beam 60 of the elevator car 62. The outer ends 80 of the transmitting member 74 co-act with the gripping means 68 as follows: The outer ends 80 of the transmitting member form stoppers in each gripping means 68 for a spring 82 adjusting the position of a counter wedge 84 (see also FIG. 4) which counter wedge 84 acts in a per se known way as a guiding surface for a gripping wedge 86 provided to engage the respective guide rail 64, 66. As FIG. 4 shows, the counter wedge 84 itself is positioned on a counter surface 87 which is tilted in an acute angle with respect to the corresponding guide rail 64, 66.

In the embodiment of FIGS. 3 and 4 the bearings 70, 72 at the bottom end of the sling bottom beam together with the transmitting member 74 and the springs 82 and counter wedges 84 form an adjusting means to adjust the friction force exerted by the gripping wedges 86 on the guide rails 64, 66.

The weight of the compensation ropes 76 acting on the middle of the transmitting member 74 varies according the position of the elevator car 62 in the elevator shaft. A higher position in the elevator shaft results in an increasing weight of the compensation ropes 76 acting on the center of the transmitting member. As the transmitting member has a certain elasticity, it is bent by the weight of the compensation ropes which leads to a vertical displacement of the ends 80 of the transmitting members which are again affecting via the springs 82 the position of the counter wedges 84 on the counter surfaces 87. The position of the counter wedge 84 again determines the gripping force of the gripping wedges 86 in case of a braking action.

Therefore, the adjusting means are implemented as a pure mechanical transmitting means between the weight of the compensation ropes 76 and the adjustment of the gripping force of the gripping wedges 86. By this means the gripping force can be adjusted according to the position of the elevator car in the elevator shaft and does not necessitate any further installations in the elevator shaft as it is necessary in connection with FIG. 1.

Buffers 78 are provided between the center of the transmitting member 74 and the sling bottom beam 60 of the elevator car 72, which buffers have the following function: In case there is a sudden loss of suspension (e.g. all hoisting ropes brake) the elevator car will rush downwards accelerated by earth gravity. This again leads to the fact that the weight of the compensation ropes 76 acting on the middle of the transmitting member 74 becomes zero which would nullify the adjustment via the adjusting means 72, 74, 82, 84. Therefore, the buffers ensure that any change of the shape of the transmitting member 74, i.e. any change to the bending of the transmitting member 74 may only occur with a dampening or delay of several seconds. This leads to the result that in case of a loss of suspension the weight of the compensation ropes 76 acting on the transmitting member becomes zero but the buffers 78 delay the returning of the shape of the transmitting member 74. The buffers will not prevent the normal bending of the transmitting members affected by the changing weight of the compensation ropes 76 when the elevator car 62 travels with nominal speed through the elevator shaft, as this bending takes place very slowly and thus unaffected by the dampening effect of the buffers 78. Therefore, the only function of the buffer 78 is to prevent sudden change of the bending of the transmitting member 76 as it happens e.g. in case of a loss of suspension.

The transmitting member can also be implemented with a different design. Thus, the transmitting member 74 may be a rigid bar which is not connected to the sling bottom bar 60 via bearings 70, 72 but only via the buffers 78. In this case the compensation rope weight acts via the transmitting member 74 directly to the adjusting parts, i.e. springs 82 and counter wedges 84 of the gripping means 68. In this case the adjustment of the gripping force would not take place by the variation of the shape of the transmitting member but by the variation of the position of the transmitting member. Also in this case the buffers 78 are provided to prevent a sudden change of the position of the transmitting member 74.

FIG. 4 shows the device in braking situation where the gripping wedge 86 has engaged the guide rail after being pulled up by means for actuating the braking (not shown), such as overspeed governor rope connected to the gripping wedge 86. Adjustment before the braking by moving the end 80 in figure downwards has increased the amount of reaction forces that can be produced by the mounting for countering the forces affecting in the gripping wedge 86 because of the friction forces. This is because moving the end 80 downwards has caused that the spring needs to be in more compressed state than before the adjustment, in order to have the same position of the gripping during braking. Thus, the ability of the mounting to produce reaction force has increased. Thus, the adjustment has changed the limit of friction force by affecting the yielding properties of the spring 82 during braking. The spings 82 are preferably compression springs giving increasing force under compression.

For the skilled person the above-mentioned embodiments are not intended to limit the invention but the invention may be carried out within the scope of the appended patent claims.

In the embodiment of FIGS. 3 and 4 the weight of the compensation cables could be substituted by the weight of the elevator supply cables. Furthermore, both the compensation ropes as well as the elevator supply cables could be used for the bending of the transmitting member.

In the embodiments of FIG. 3 the buffers or dampers have a high hysteresis in their action preventing fast changes. Instead of buffers or dampers also a system could be used which has a high inertia, e.g. a high mass protecting against fast changes.

The adjustment of the gripping means 68 in FIGS. 3 and 4 does not necessitate counter wedges but the adjustment can be directly performed on the operation of the gripping wedges. The invention is particularly intended for high rise buildings, i.e. elevator shafts above 100 m, particularly for elevator shafts up to and above 300 m. The adjusting means of the invention allow a quite constant deceleration of the elevator car along the elevator shaft with values preferably between 0.2 and 1.0 g (g=earth gravity).

Furthermore, it is not necessary that the suspension of the compensation ropes and/or elevator supply cables is arranged at the bottom of the elevator car but it can be located at one side of the elevator car, preferably in a certain vicinity to the gripping means.

If gripping means are also provided at the top part of the elevator car mechanical transmitting means, e.g. bars, could be provided to mechanically transfer the adjustment of the lower gripping means 68 of the FIGS. 3 and 4 to the upper gripping means.

Basically, it may be sufficient that only a part of the gripping means of an elevator car are adjusted according to the invention whereas other gripping means are not adjusted according to the car position.

The invention claimed is:

1. An elevator comprising:

at least one guide rail;

a plurality of compensation ropes;

a car configured to be moved along the at least one guide rail in an elevator guide way, the car comprising a brake configured to slow and/or stop movement of the car by gripping the at least one guide rail, the brake comprising:

a gripping means configured to grip the at least one guide rail to thereby exert a friction force thereon; and an adjusting means configured to adjust the gripping means with respect to the friction force exerted on the at least one guide rail, the adjusting means comprising a transmitting member, wherein the adjusting means is configured to adjust the gripping means depending on a position of the car in the elevator guide way, wherein the transmitting member is a horizontal bar that is horizontal with respect to the at least one guide rail and is connected to the compensation ropes, wherein the transmitting member has outer ends which are configured to apply a transmitting force to the gripping means to alter the friction force exerted by the gripping means to the at least one guide rail, wherein the transmitting force is configured to vary depending on the weight of the compensation ropes at a given elevation, and wherein the adjusting means is configured to pre-adjust the gripping means by setting the gripping means constantly in a desired position before the braking is needed.

2. The elevator according to claim 1, wherein the adjusting means and/or gripping means comprises a limit means configured to limit the friction force exerted by the gripping means on the at least one guide rail, and wherein the adjusting means is configured to adjust a limiting effect of the limit means depending on a position of the car in the elevator guide way.

3. The elevator according to claim 2, wherein said gripping means comprises a gripping element configured to engage the at least one guide rail, and wherein said limit means comprises a spring, the spring forms a yieldable mounting for the gripping element so as to limit the friction force exerted to the at least one guide rail by said gripping element, and wherein said adjusting means is configured to adjust the compression of the spring.

4. The elevator according to claim 3, wherein the gripping element is a counter wedge, and wherein the transmitting member acts on the counter wedge via said spring.

5. The elevator according to claim 2, wherein the limit means is a mechanical limit means.

6. The elevator according to claim 2, wherein said limit means is part of the gripping means.

7. The elevator according to claim 2, further comprising an indication means configured to determine a position of the car in the elevator guide way.

8. The elevator according to claim 5, wherein said gripping means comprises a gripping element configured to engage the at least one guide rail, and said limit means comprises a spring, the spring forms a yieldable mounting for the gripping element so as to limit the gripping force exerted to the at least one guide rail by said gripping element of the gripping means, and wherein said adjusting means is configured to adjust the compression of the spring.

9. The elevator according to claim 1, further comprising an indication means configured to determine a position of the car in the elevator guide way.

10. The elevator according to claim 9, wherein the indication means determines the car position based on a weight of at least one rope portion suspended on the elevator car.

11. The elevator according to claim 10, wherein the at least one rope portion is a compensation rope and/or a car supply cable.

12. The elevator according to claim 1, wherein at least one buffer or damper is provided between the transmitting member and the elevator car to delay/dampen the change of the shape and/or position of the transmitting member.

13. The elevator according to claim 1, wherein said adjusting means is configured to adjust the limit means or gripping means independent of an operational status of the elevator.

14. The elevator according to claim 1, wherein said gripping means comprises at least one gripping wedge.

15. The elevator according to claim 1, wherein said adjusting means is configured to continuously adjust the gripping means.

16. The elevator according to claim 1, wherein the adjusting means is configured to be adjusted depending on a moving direction of the elevator car and/or depending on a car load.

17. A method for adjusting the braking force in an elevator, the method comprising:

providing an elevator, the elevator comprising:

at least one guide rail;

an elevator car;

a plurality of compensation ropes;

an elevator brake, the brake comprising:

a gripping means; and an adjusting means comprising a transmitting member, wherein the transmitting member is a bar having outer ends and is connected to said compensation ropes and is connected to said gripping means at said outer ends;

gripping the at least one guide rail with the gripping means such that a friction force is applied to the guide rail; and adjusting the friction force applied to the at least one guide rail by applying a transmitting force to the gripping means with said transmitting member, wherein the transmitting force varies depending on a weight of the compensation ropes at a given elevation.

* * * * *